US005265583A

United States Patent [19]

Otto

[11] Patent Number: 5,265,583

[45] Date of Patent: Nov. 30, 1993

[54] AUTOMATIC BALL CONTROL APPARATUS

[76] Inventor: Carlos F. Otto, 5245 Fishing Bridge, Cheyenne, Wyo. 82009

[21] Appl. No.: 710,651

[22] Filed: Jun. 5, 1991

[51] Int. Cl.[5] ..... F41B 11/00

[52] U.S. Cl. ..... 124/81; 124/26; 124/84; 273/26 D

[58] Field of Search ..... 124/81, 83, 84, 26, 124/85; 273/26 D, 29 A

[56] References Cited

U.S. PATENT DOCUMENTS

| | | | |
|---|---|---|---|
| 3,288,127 | 11/1966 | Bullock | 124/81 X |
| 3,308,802 | 3/1967 | Applegate | 124/81 X |
| 3,640,263 | 2/1972 | Rhodes | 124/81 X |
| 3,807,379 | 4/1974 | Vodinh | 124/81 X |
| 3,838,676 | 10/1974 | Kahelin | 124/81 X |
| 4,006,726 | 2/1977 | Sweeton et al. | 124/81 |
| 4,501,257 | 2/1985 | Kholin | 124/81 |
| 4,570,607 | 2/1986 | Stokes | 124/81 X |

*Primary Examiner*—Randolph A. Reese
*Assistant Examiner*—Harry C. Kim
*Attorney, Agent, or Firm*—Phillip A. Rein

[57] ABSTRACT

This invention relates to an automatic ball control apparatus readily connectable to a ball ejector barrel on a ball ejector machine to impart top spin to ejected tennis ball members. The automatic ball control apparatus includes a ball top spin actuator assembly in one embodiment which includes 1) a fixed extension sleeve assembly secured to an outer end of the ball ejector barrel; 2) a sliding actuator sleeve assembly mounted about the fixed extension sleeve assembly; and 3) a spin actuator paddle assembly pivotally connected to the sliding actuator sleeve assembly. The spin actuator paddle assembly includes a main support lever member which is periodically pivotable to contact and impart top spin motion to a contacting tennis ball member. A second embodiment includes a ball top spin actuator assembly including 1) a fixed extension sleeve assembly secured to an outer end of the ball ejector barrel; and 2) a spin actuator paddle assembly connected to the fixed extension sleeve assembly. The spin actuator paddle assembly includes a main support level member having an arcuate contact surface which is pivotal to contact a tennis ball member to impart top spin thereto. The automatic ball control apparatus is operable to impart a combination of lateral, oscillating, and top spin motion to a tennis ball in a random fashion.

19 Claims, 6 Drawing Sheets

AUTOMATIC BALL CONTROL APPARATUS

This invention has been described in a Disclosure Document, Number 228754, entitled "Vertical Oscillator in Combination with Automatically Controlled Top Spin Apparatus for use with Pneumatic Tennis Ball Machines", filed on Jun. 6, 1989 in the United States Patent Office.

PRIOR ART

A patent search on this invention revealed the following United States Patents:

| U.S. Pat. No. | Invention | Inventor |
|---|---|---|
| 2,182,369 | BASEBALL PROJECTING APPARATUS | Christopher T. Barron |
| 2,935,980 | TENNIS BALL SERVER | John P. Garver |
| 3,640,263 | AUTOMATIC BALL-THROWING MACHINE | Barry V. Rhodes |
| 4,270,511 | APPARATUS FOR SHOOTING A CURVE BALL | Goro Ehama |
| 4,570,607 | TENNIS BALL THROWING MACHINE WITH CONTINUOUS ROTATABLE BAREL HAVING FRICTION STRIP ON ONE SIDE ONLY OF INNER WALL | Gilbert A. Stokes |

The Barron patent discloses a baseball projecting apparatus having a device thereon to contact a baseball and impart a curve to the thrown baseball.

The Garver patent discloses a tennis ball server operable to serve a tennis ball, impart a spin to the tennis ball, and teaches the known prior art structure of utilizing air pressure to eject subject tennis ball.

The Rhodes patent discloses an automatic ball-throwing machine utilizing air pressure and having a means for directing tennis balls along different trajectories.

The Ehama patent discloses an apparatus for shooting a ball along a curved path in the practice of baseball, tennis, or table tennis.

The Stokes patent discloses a tennis ball throwing machine having a movable ejector barrel having means therein for spinning the subject tennis ball.

BACKGROUND OF THE INVENTION

Prior to this invention, automatically controlled top spin in combination with vertical oscillation by a tennis ball machine has not been effected. There has been need of economical means of providing vertical oscillation in combination with automatically controlled variable top spin to a tennis ball member propelled by a tennis ball ejector machine. The principal need for such a device is to provide tennis ball member trajectory to between the base line of a tennis court and near a tennis net on a receiver's side of the tennis court while automatically providing the required amount of top spin to prevent the tennis ball member trajectory going beyond a base line of the receiver's side of the tennis court before contact with the court's surface while simultaneously employing maximum ball velocity and lob height of the ball above the tennis net. The present invention is designed for attachment to existing or newly manufactured pneumatic type ball ejector machines employing a rigid barrel attached to a flexible air/ball conveyor hose with a collar attached to an adjustable bracket. This invention provides a greater variety of practice to all levels of tennis play for tennis players using above described tennis ball ejector machines prior to this invention. The present invention may be incorporated in the manufacture of new tennis ball ejector machines of the type described, whether or not having horizontal oscillating movement.

PREFERRED EMBODIMENT OF THE INVENTION

In one preferred embodiment of this invention, an automatic ball control apparatus is operable to be utilized in combination with a ball ejector machine including a main support housing mounted on a support wheel assembly having a ball receptacle housing which holds tennis ball members to be ejected therefrom. The ball ejector machine has a ball discharge assembly which is operable to utilize air pressure to pick up a tennis ball member and to discharge same outwardly through a ball ejector barrel.

The ball ejector barrel is controlled through a barrel oscillator assembly which is operable to move the ball ejector barrel in an oscillating (up-and-down path) and including lateral movement of the ball ejector barrel in order to randomly eject tennis balls from one side of a tennis court across a tennis net into both tennis serve and back court areas in an randomly selected pattern.

The automatic ball control apparatus can be utilized with the vertical and lateral oscillator assembly of the prior art and includes a ball top spin actuator assembly having 1) a fixed extension sleeve assembly connected to the ball ejector barrel; 2) a sliding actuator sleeve assembly mounted on the fixed extension sleeve assembly; and 3) a spin actuator paddle assembly connected to the sliding actuator sleeve assembly.

The fixed extension sleeve assembly includes a fixed sleeve member connected by a sleeve anchor clamp to the ball ejector barrel. A sleeve stop clamp is connected to an outer end of the ball ejector barrel. The fixed sleeve member is provided with anchor slots and 3) cam connector slots.

The sliding actuator sleeve assembly includes a movable sleeve member, a sleeve actuator member being a compression spring member mounted between one end of the movable sleeve member and the sleeve anchor clamp and positioned about the fixed sleeve member, and a paddle actuator cam member mounted in the cam connector slots.

The movable sleeve member includes a cam receiver slot, a chain connector bracket secured to a top surface, and an adjustment opening having a set screw therein to adjust an amount of allowable axial movement of the movable sleeve member on the fixed sleeve member.

The paddle actuator cam member has an inclined cam surface which contains a portion of the spin actuator paddle assembly on vertical movement of the ball ejector barrel.

The spin actuator paddle assembly includes 1) a spin paddle assembly pivotally connected to the movable sleeve member; 2) a ball actuator lever member connected to the spin paddle assembly; and 3) a paddle bias member being an elastic band mounted about the ball actuator lever member and the movable sleeve member.

The spin paddle assembly includes a main support lever member having a lever actuator assembly connected thereto. The main support lever member is of a U-shape in transverse cross section having a bottom wall with a hinge member for piovtal connection to a lower surface of the movable sleeve member.

The lever actuator assembly consists of a roller member rotatably mounted on a support shaft which is connected to one end of the main support lever member.

The ball actuator lever member includes an arcuate support body having an outer arcuate contact surface to receive a tennis ball member thereagainst to achieve a top spin thereto and anchor bolt members for securing the arcuate support body to an outer end of the main support lever member.

A second embodiment of a ball top spin actuator assembly includes 1) a fixed extension sleeve assembly which is secured to an outer end of the ball ejector barrel; and 2) a spin actuator paddle assembly. The fixed extension sleeve assembly includes a fixed sleeve member connected by wing nut members contacting an outer surface of the ball ejector barrel.

The spin actuator paddle assembly includes a spin paddle assembly pivotally connected to a movable cam actuator assembly which, in turn, is connected to the fixed sleeve member.

The spin paddle assembly includes a main support lever member having an actuator cam member and a ball actuator lever member mounted thereon. The ball actuator lever member includes an arcuate contact surface to engage the tennis ball members thereagainst to impart top spin thereto.

The actuator cam member is provided with a cam surface to be engaged by the movable cam actuator assembly to pivotally move the ball actuator lever member.

The movable cam actuator assembly includes a cam support channel secured to an outer lower surface of the fixed sleeve member and a sliding cam assembly connected to the cam support channel.

The cam support channel is of a generally U-shape in transverse cross section having a lever spring member therein connected at one end to the fixed sleeve member and engagable with the ball actuator lever member to bias in one direction of rotational movement.

The sliding cam assembly includes a main cam body member having a chain connector section attached to one end of a cable or beaded chain member which, in turn, is connected to a portion of the ball ejector machine.

On vertical movement of the ball ejector barrel, the sliding cam assembly is operable to engage an actuator a cam surface of the actuator cam member to pivot the ball actuator lever member to vary contact with an ejected tennis ball member to impart varying degrees of top spin thereto on vertical oscillation and lateral movement of the ball ejector barrel.

OBJECTS OF THE INVENTION

One object of this invention is to provide an automatic ball control apparatus for providing controlled and automatic variable top spin to a tennis ball member in combination with vertical oscillation when attached to, or made a part of, a ball ejector machine for providing greater versatility in tennis practice.

Another object of this invention is to provide an automatic ball control apparatus which is easily and readily attached to existing ball ejector machines without alteration thereto and requiring a minimum amount of tools and skill for mounting thereon.

One other object of this invention is to provide an automatic ball control apparatus having a ball top spin actuator assembly easily connected to existing or new tennis ball ejector machines to provide trajectory to ejected tennis ball members of varying heights while simultaneously providing automatically controlled variable top spin with subject top spin varying in ratio to height of a tennis ball member lob trajectory.

One further object of this invention is to provide an automatic ball control apparatus which can be readily attached to new or existing tennis ball ejector machines and having a ball top spin actuator assembly operable to contact a tennis ball member in varying degrees on its final ejection to provide variable top speed to the tennis ball member in ratio to a tennis ball member lob trajectory therefrom.

Still, one other object of this invention is to provide an automatic ball control apparatus which can be built into new or attached to existing tennis ball ejector machines which is economical to manufacture; simple to install; providing greater versatility in movement of a tennis ball member from the tennis ball ejector machine; providing a greater practice versatility to any tennis ball ejector machine in existence; and substantially maintenance free.

Various other objects, advantages, and features of the invention will become apparent to those skilled in the art from the following discussion, taken in conjunction with the accompanying drawings, in which:

FIGURES OF THE INVENTION

Figure 1:
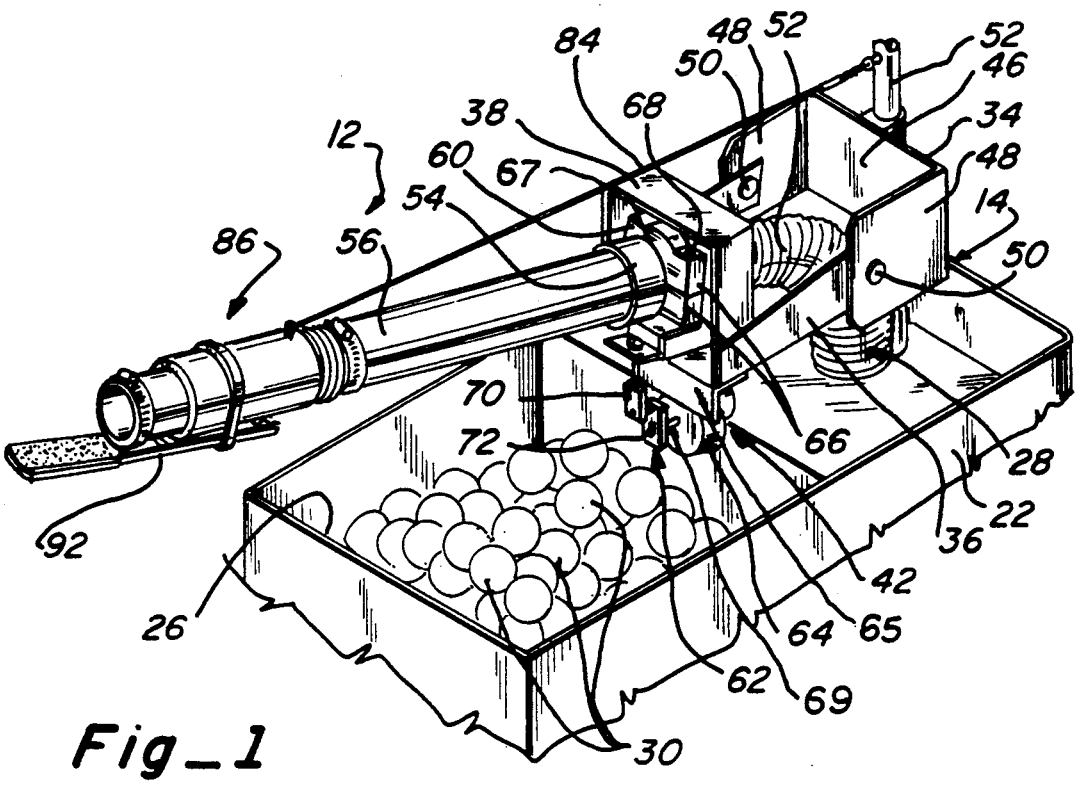
FIG. 1 is a fragmentary perspective view of a tennis ball ejector machine having an automatic ball control apparatus of this invention attached thereto.

The following is a discussion and description of preferred specific embodiments of the automatic ball control apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Figure 4:
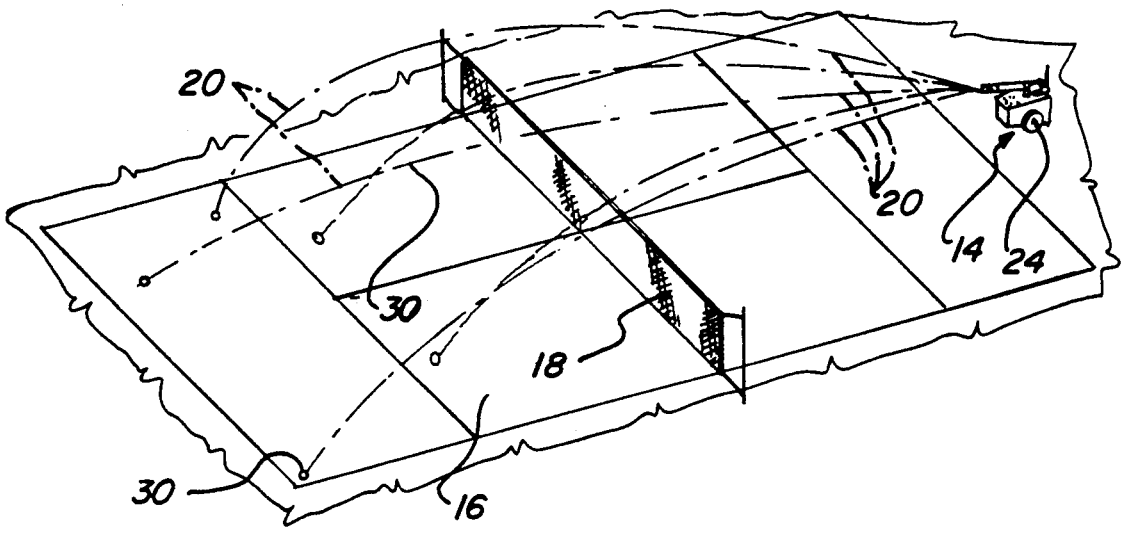
FIG. 4 illustrates the tennis ball ejector machine with the automatic ball control apparatus of this invention attached thereto as used on a tennis court.
Figure 5:
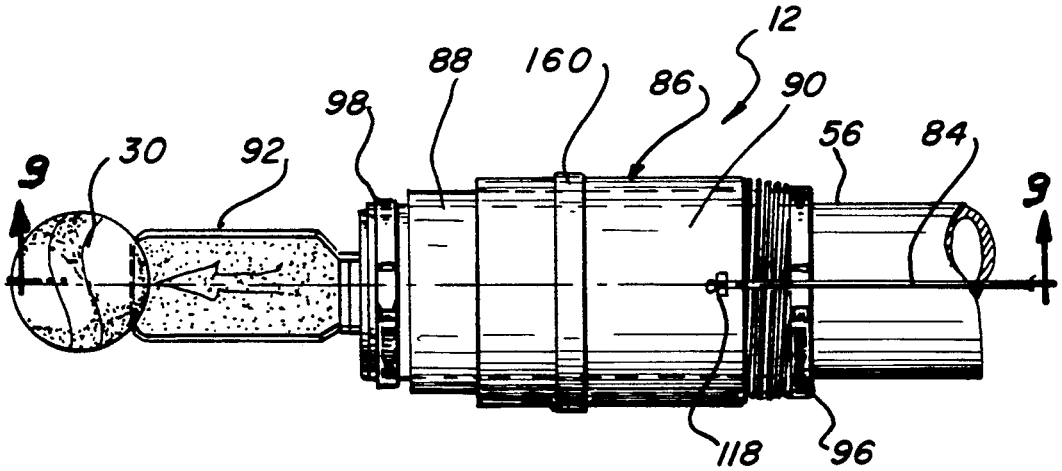
FIG. 5 is an enlarged fragmentary top plan view taken along line 5—5 in FIG. 2.
Figure 6:
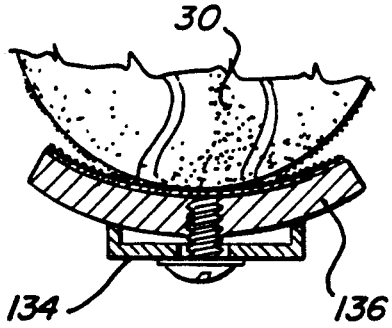
FIG. 6 is an enlarged fragmentary sectional view taken along line 6—6 in FIG. 2.
Figure 7:
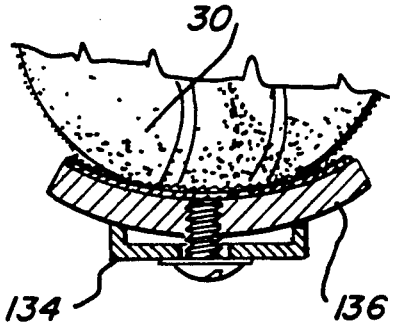
FIG. 7 is an enlarged fragmentary sectional view taken along line 7—7 in FIG. 3.

Referring to the drawings in detail and, in particular to FIGS. 1 and 4, an automatic ball control apparatus of this invention, indicated generally at 12, is utilized in conjunction with a tennis ball ejector machine 14 which is placed behind a base line on a tennis court 16 of a conventional nature having a central tennis net member 18.

The tennis ball ejector machine 14 is operable in order to propel tennis ball members 30 through a ball trajectory 20 as specifically noted in FIG. 4. It is seen that the tennis ball members 30 ejected from the ball ejector machine 14 have various trajectories such as a low trajectory to land just across the tennis net member 18 and an elevated trajectory to land adjacent the base line in the receiver's court.

Due to the nature of the automatic ball control apparatus 12 of this invention, the tennis ball members 30 are randomly ejected and cover important areas of the receiver's side of the tennis court 16 such as an area close to a back service line, laterally to the court's parallel side lines, and rearwardly to the base line. The ball ejector machine 14 is mounted on a support wheel assembly 24 so as to be easily movable to any desired location on the tennis court 16.

As noted in FIG. 1, the ball ejector machine 14 includes a main support housing 22 having a ball receptacle housing 26 therein and a ball discharge assembly 28. The ball receptacle housing 26 is operable to receive and hold numerous tennis ball members 30 for automatically feeding same into the ball discharge assembly 28.

The ball discharge assembly 28 can be of various types, normally of a pneumatic type, to propel the tennis ball members 30 outwardly therefrom as shown in FIG. 4.

The ball discharge assembly 28 includes 1) a support post member 32; 2) a first conveyor tube bracket 34 secured to the support post member 32; 3) an adjustable conveyor tube bracket 36 pivotally connected to the first conveyor tube bracket 34; 4) a hose guide bracket 38 generally of square shape secured to an outer end of the adjustable conveyor tube bracket 36; 5) a ball conveyor assembly 40 having one end connected to a pneumatic output from the ball ejector machine 14; 6) a barrel oscillator assembly 42 connected to the adjustable conveyor tube bracket 36; and 7) a flexible connector assembly 44 connected at one end to the support post member 32 and at an opposite end to a portion of the automatic ball control apparatus 12.

The support post member 32 is capable of partial, reciprocal rotation through a mechanism in the ball ejector machine 14 to move the interconnected hose guide bracket 38 horizontally in a manner to be explained.

The first conveyor tube bracket 34 is of a generally U-shape having a back wall 46 secured by a bracket member 35 to the support post member 32 and integral, parallel side walls 48.

The adjustable conveyor tube bracket 36 is connected by connector members 50 to the first conveyor tube bracket 34. The connector members 50 are operable to permit pivoted movement of the conveyor tube bracket 36 and being locked in a given selected elevational position to vary the trajectory of the tennis ball members 30 when ejected from the ball ejector machine 14.

The ball conveyor assembly 40 includes 1) a flexible ball conveyor hose 52 secured at one end to a pneumatic propulsion mechanism of the ball ejector machine 14; 2) a rigid connector sleeve 54 secured to an outer end of the flexible ball conveyor hose 52; and 3) a ball ejector barrel 56 normally constructed of a rigid cylindrical steel or plastic material having its inner end connected to the rigid connector sleeve 54.

The barrel oscillator assembly 42 includes 1) an oscillator bracket assembly 60 mounted about the rigid connector sleeve 54; 2) an oscillator crank assembly 62 connected to the oscillator bracket assembly 60; and 3) a drive gear and motor assembly 64 interconnected to the oscillator crank assembly 62 and, additionally, secured through an angle iron member 65 to a lower outer surface of the adjustable conveyor tube bracket 36.

The oscillator bracket assembly 60 includes a stepped bracket member 79 and a pair of sleeve connector clamp members 66, each having a central semi-circular opening 67 and secured to each other by anchor nut and bolt members 68. The sleeve connector clamp members 66 are securely clamped about the rigid connector sleeves 54.

The oscillator crank assembly 62 includes a first crank member 70 having one end connected to the stepped bracket member 69 and, at an opposite end, connected to a second crank member 72 which, in turn, is connected to the drive gear and motor assembly 64.

The first crank member 70 has a connector end 74 connected by a shaft portion 75 to the stepped bracket member 79 and having an opposite end connected to a connector bolt 76.

The second crank member 72 has a connector end 78 connected to the connector bolt 76 and an opposite end has a drive shaft hole 80 to receive an output shaft 69 from the drive gear and motor assembly 64.

The connector bolt 76 allows relative rotational movement at the connected ends of the first crank member 70 and the second crank member 72.

The drive gear and motor assembly 64 is of a conventional nature powered through a power cord and control means 81 having a gear reduction drive motor in order to rotate the output shaft 69 which is secured to the second crank member 72.

Figure 2:
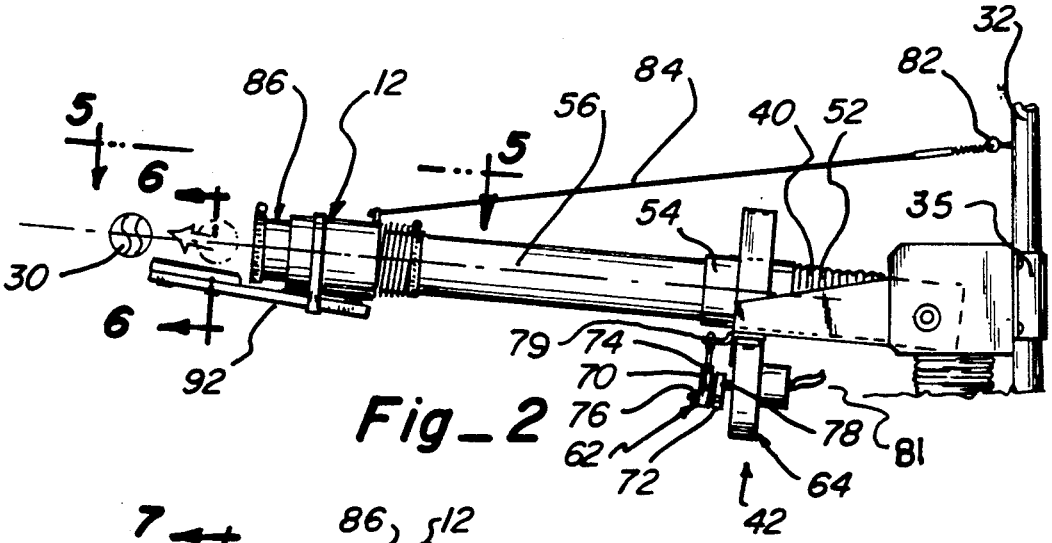
FIG. 2 is a fragmentary side elevational view of the tennis ball ejector machine and automatic ball control apparatus as shown in FIG. 1.
Figure 3:
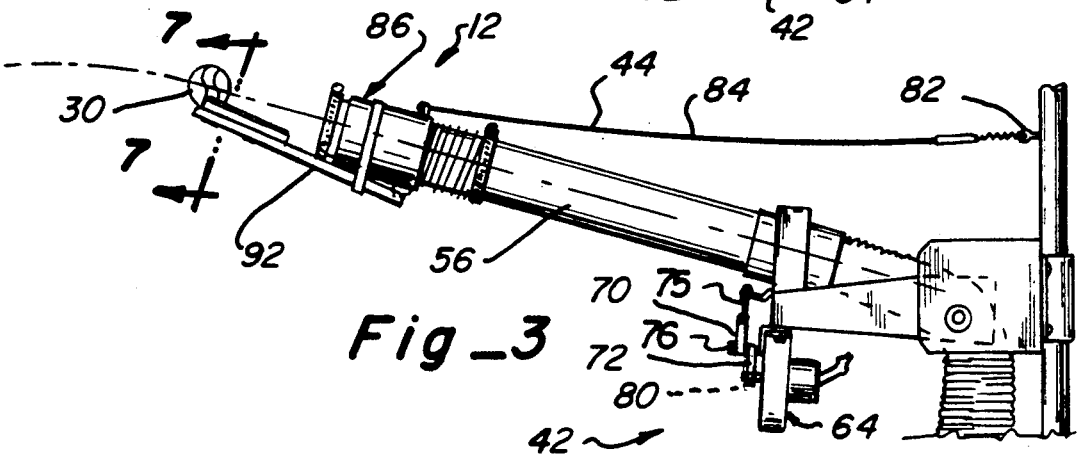
FIG. 3 is a side elevational view substantially identical to FIG. 2 showing a different position of a ball ejector barrel.

Therefore, on comparison of FIGS. 2 and 3, vertical oscillating movement is achieved through the oscillating crank assembly 62 to move the ball ejector barrel 56 in an oscillatory path. The ball ejector machine 14, through the controlled partial rotational movement of the support post member 32 and the oscillating movement of the barrel oscillating assembly 42, operates to achieve lateral plus vertical oscillating movement of the ball ejector barrel 56.

The automatic ball control apparatus 12 includes a ball top spin actuator assembly 86 which is connected to the ball ejector barrel 56. More specifically, the ball top spin actuator assembly 86 includes 1) a fixed extension sleeve assembly 88 connected to the outer end of the ball ejector barrel 56; 2) a sliding actuator sleeve assembly 90 which is mounted about the fixed extension sleeve assembly 86; and 3) a spin actuator paddle assembly 92 which is pivotally connected to the sliding actuator sleeve assembly 90.

Figure 8:
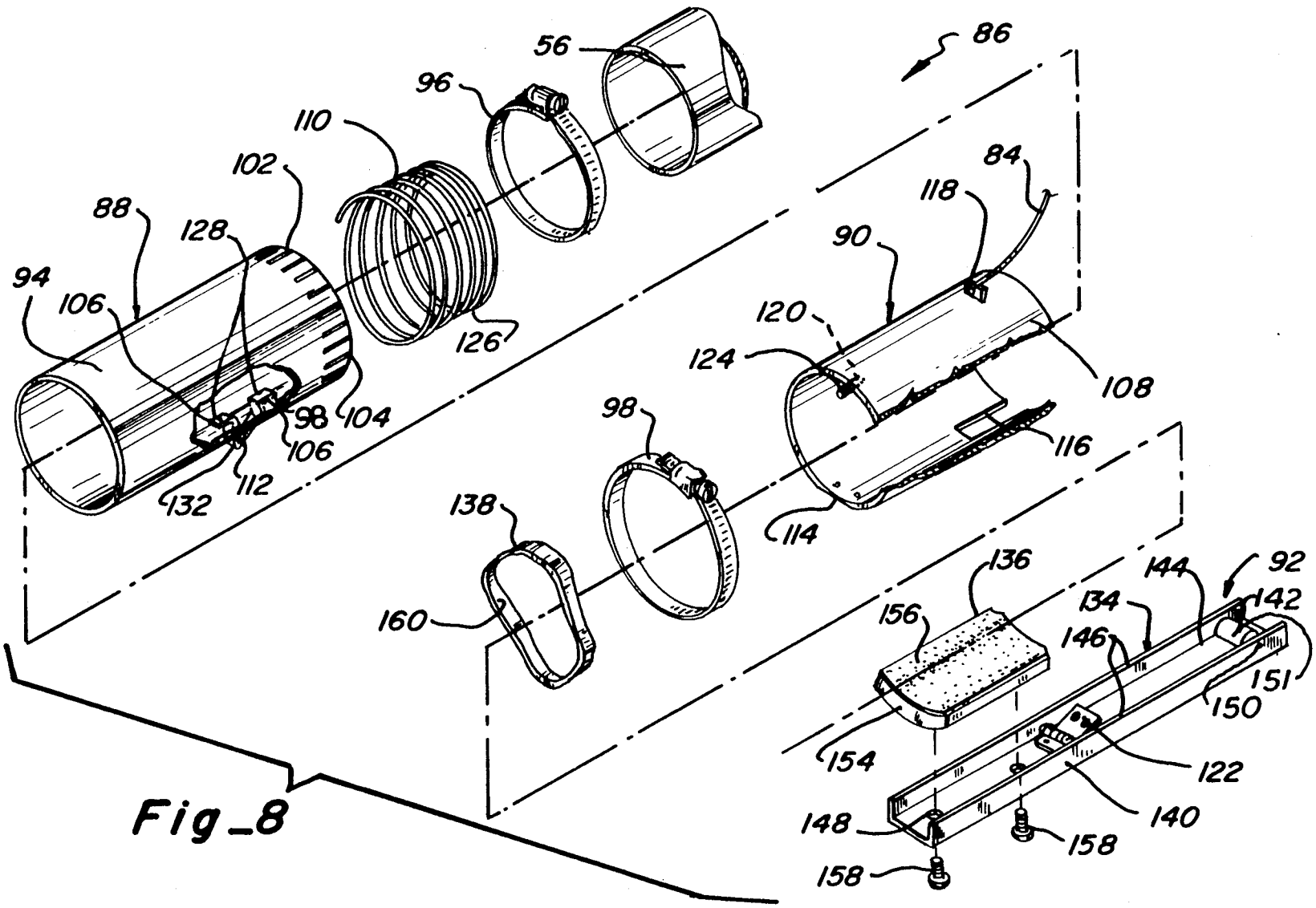
FIG. 8 is an exploded perspective view of a ball top spin actuator assembly of the automatic ball control apparatus of this invention.

As best shown in FIG. 8, the fixed extension sleeve assembly 88 includes a cylindrical fixed sleeve member 94 connected at one end by a sleeve anchor clamp 96 to the outer end of the ball ejector barrel 56 and having a sleeve stop clamp 98 secured to an outer end of the ball ejector barrel 56.

The fixed sleeve member 94 has a connector end 102 provided with a pluralty of spaced anchor slots 104 and cam connector slots 106 to receive a cam member therein as will be explained. The anchor slots 104 are provided in order to obtain a firm clamping action about the outer end of the ball ejector barrel 56 when serving the sleeve anchor clamp 96 thereon.

The sliding actuator sleeve assembly 90 includes 1) a movable sleeve member 108; 2) a sleeve actuator member 110 mounted between the sleeve anchor clamp 96 and an outer end of the movable sleeve member 108; and 3) a paddle actuator cam member 112 to be mounted within the cam connector slots 106 on the fixed sleeve member 94.

The movable sleeve member 108 includes 1) a flat connector surface 114; 2) a cam receiver slot 116 to permit the paddle actuator cam member 112 to extend therethrough; and 3) a chain connector bracket 118 to be connected to an outer end of the beaded chain member 84. The flat connector surface 114 is operable to secure a hinge member 122 thereto for pivot connection to the spin actuator paddle assembly 92.

The threaded adjustment opening 120 is operable to receive a set screw 124 therein for top spin adjustment purposes as will be explained.

The sleeve actuator member 110 comprises a compression spring member 126.

The paddle actuator cam member 112 is provided with connector legs 128 mounted through the cam connector slots 106 in the fixed sleeve member 94 and having an inclined cam surface 132.

As best shown in FIG. 8, the spin actuator paddle assembly 92 includes 1) a spin paddle assembly 134 pivotally connected to the hinge member 122; 2) a ball actuator lever member 136 connected to one end of the spin paddle assembly 134; and 3) a paddle bias member 138 operably connected to the ball actuator lever member 136 and mounted about the movable sleeve member 108.

The spin paddle assembly 134 includes a main support lever member 140 of generally U-shape in transverse cross section and having a lever actuator assembly 142 connected at an opposite end thereof. The main support lever member 140 includes a bottom wall 144 having integral parallel side walls 146 and spaced connector holes 148 in the bottom wall 144.

The lever actuator assembly 142 includes a support shaft 150 having a roller member 151 mounted thereon and connected to one end of the main support lever member 140 opposite from attachment of the ball actuator lever member 136.

The ball actuator lever member 136 includes an arcuate support body 154 having an outer arcuate ball contact surface 156 and is secured by anchor bolt members 158 connected to the arcuate support body 154. The use of the anchor bolt members 158 allow the arcuate support body 154 to be removed and replaced on wear of the arcuate contact surface 156 during a maintenance operation.

The spaced connector openings 148 may be aligned slots permitting axial adjustment of the arcuate support body 154 for top spin adjustment as will be noted.

The paddle bias member 138 is a flexible elastic band 160 which may be constructed of a rubber material.

Figure 11:
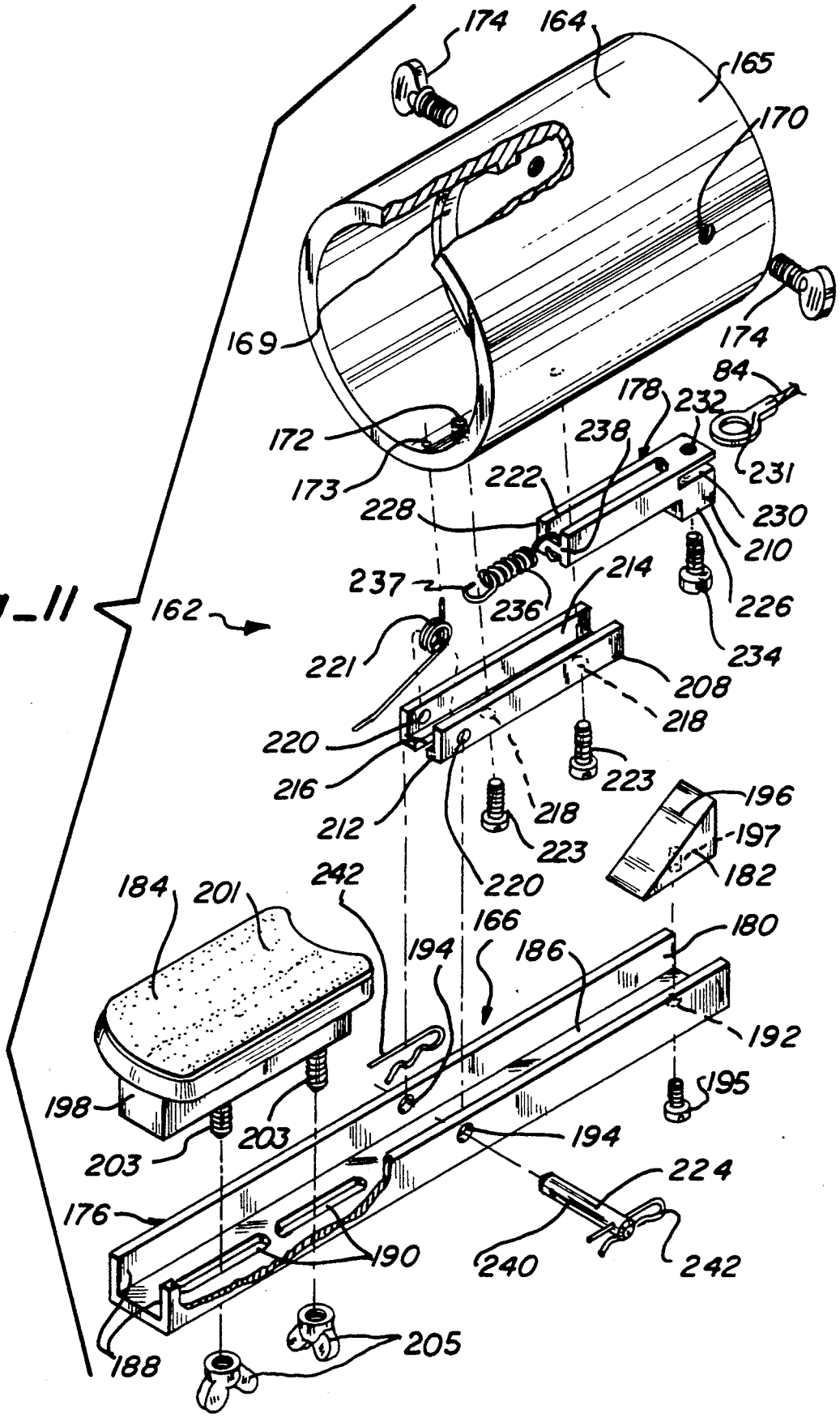
FIG. 11 is an exploded perspective view of a second embodiment of a ball top spin actuator assembly of the automatic ball control apparatus of this invention.
Figure 12:
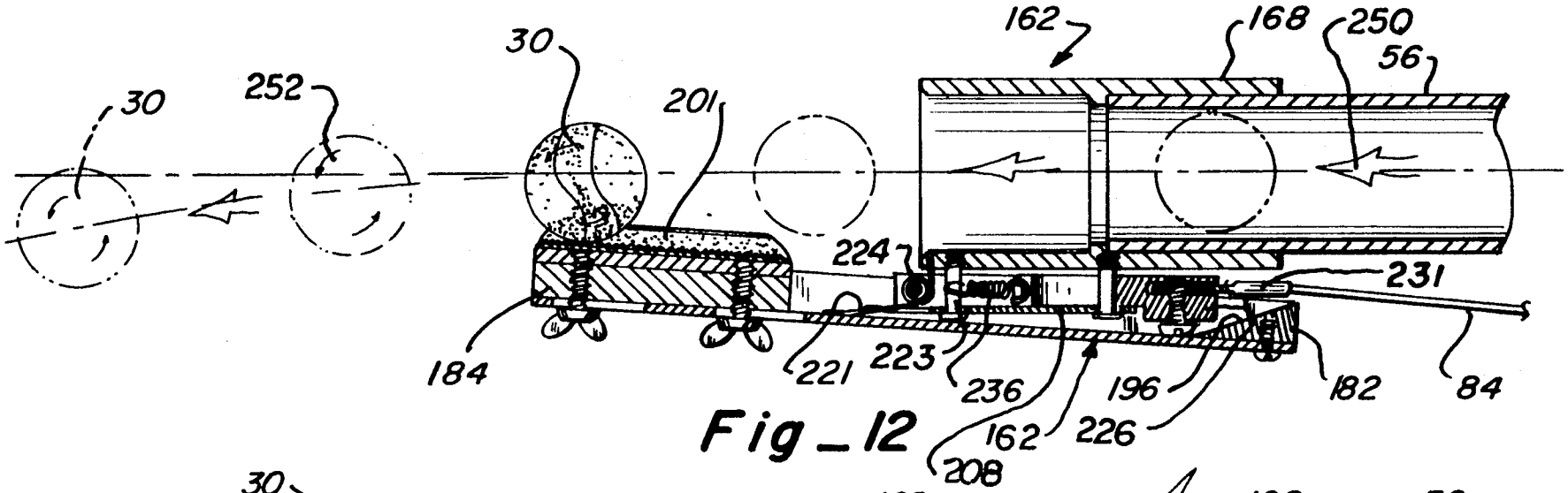
FIG. 12 is a sectional view similar to FIG. 9 illustrating one operational condition of the second embodiment shown in FIG. 11.
Figure 13:
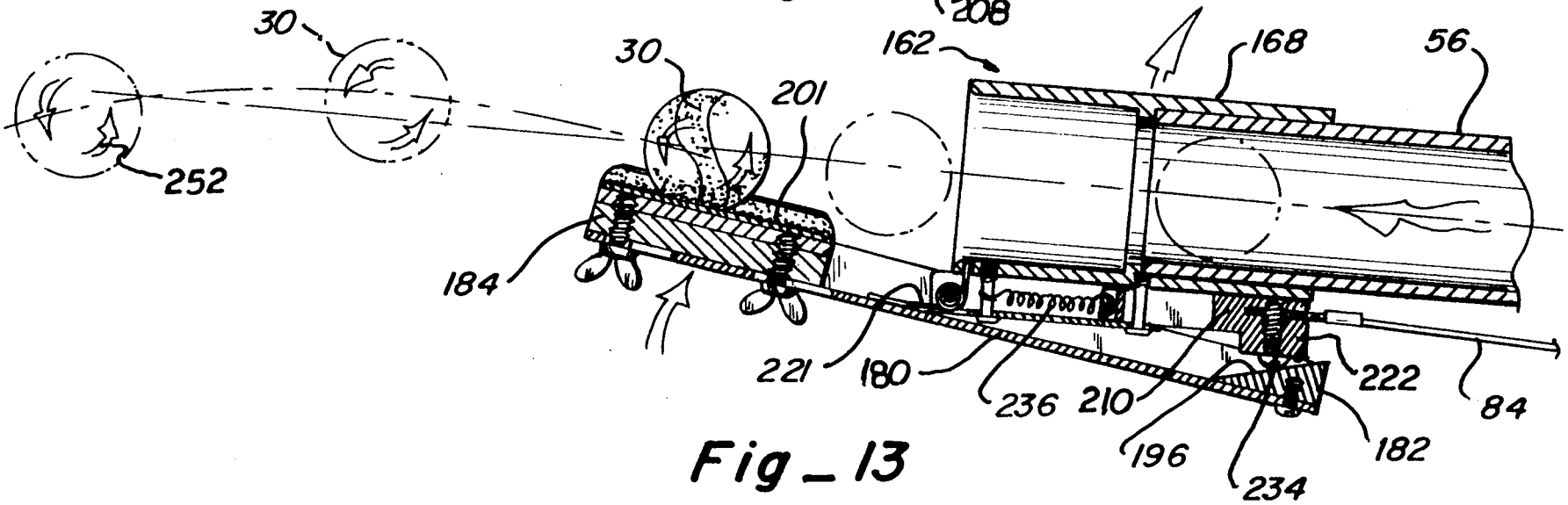
FIG. 13 is a sectional view similar to FIG. 12 illustrating a different operational condition of the second embodiment.

As noted in FIGS. 11-13, inclusive, a second embodiment of the invention is a ball top spin actuator assembly 162 which achieves a similar operation, purpose, and function of the first embodiment being the ball top spin actuator assembly 86.

The ball top spin actuator assembly 162 includes 1) a fixed extension sleeve assembly 164 which is releasably connectable to an outer end of the ball ejector barrel 56; and 2) a spin actuator paddle assembly 166 which is connected to the fixed extension sleeve assembly 164. The fixed sleeve member 168 has an inner central ridge 169, threaded anchor holes 170, paddle connector holes 172, and a forward spring connector hole 173.

The anchor holes 170 are operable to threadably receive respective wing nut member 174 therein for releasably anchoring to the ball ejector barrel 56.

As noted in FIG. 11, the spin actuator paddle assembly 166 includes a spin paddle assembly 176 pivotally connected to and cooperating with a movable cam actuator assembly 178.

The spin paddle assembly 176 includes 1) a main support lever member 180; 2) an actuator cam member 182 secured to one end of the main support lever member 180; and 3) a ball actuator lever member 184 secured to an opposite end of the main support lever member 180.

The main support lever member 180 is of U-shape in transverse cross section having a bottom wall 186 with integral parallel side walls 188. The bottom wall 186 is provided with elongated spaced aligned connector slots 190 and a cam connector hole 192. The side walls 188 are provided with aligned pivot connector holes 194 for connection to the movable cam actuator assembly 178 as will be explained.

The actuator cam member 182 is of a wedge shape connected to one end of the main support lever member 180 by a bolt member 195 extended through the cam connector hole 192 into a threaded opening 197 in the actuator cam member 182.

The actuator cam member 182 is provided with an outwardly, upwardly inclined cam surface 196 engagable with the movable cam actuator assembly 178.

The ball actuator lever member 184 is similar to the previously described ball actuator lever member 136 having an arcuate support body 198 with an upper arcuate contact surface 201. The arcuate support body 198 includes anchor bolts 203 extended therefrom and mountable within respecive ones of the connector slots 190 and secured in an adjusted position by wing nuts 205.

The arcuate contact surface 201 is constructed of an abrasive type material so as to impart top spin to a tennis ball member 30 contacting same as will be explained.

The movable cam actuator assembly 178 includes a cam support channel 208 which is connected to an outer lower surface of the fixed sleeve member 168 and a sliding cam assembly 210 mounted within the cam support channel 208. The cam support channel 208 is of generally U-shape in transverse cross section including a bottom wall section 212 with integral parallel side wall sections 214.

The bottom wall section 212 has 1) a spring slot 216 therein operable to receive a portion of a lever spring member 221 therethrough; and 2) anchor holes 218 for securing to a lower surface of the fixed sleeve member 168 by anchor bolt members 223 mounted in the paddle connector holes 172.

The side wall sections 214 each have an aligned pivot connector hole 220 to receive a support member therethrough.

The sliding cam assembly 210 includes a main cam body member 222 and a support lever connector assembly 224. The main cam body member 222 is of generally L-shape having a chain connector section 226 at one end and a bias connector section 228 at an opposite end.

The chain connector section 226 includes 1) a ring receiving slot 230 to receive a ring member 231 connected to an outer end of the beaded chain member 84; and 2) a threaded anchor hole 232 to receive a lock bolt member 234 therein and trained through the ring member 231 in the assembled condition.

The bias connector end 228 has a support shaft 238 to receive one end of a tension spring 236 thereabout. The tension spring 236 is of a conventional type having hook portions 237 on opposite ends thereof.

The support lever connector assembly 224 includes a pivot support pin 240 having holes at opposite ends thereof to receive anchor clip members 242 therethrough to hold the pivot support pin 240 in the assembled condition when it is mounted through the aligned pivot connector holes 194 and the pivot connector holes 220.

USE AND OPERATION OF THE INVENTION

In the use and operation of the automatic ball control apparatus 12 of this invention, it can be used in the manufacture of a new ball ejector machine 14 but is constructed so as to be readily attached to existing ball ejector means such as a tennis ball ejector machine in a retrofit installation procedure.

Figure 9:
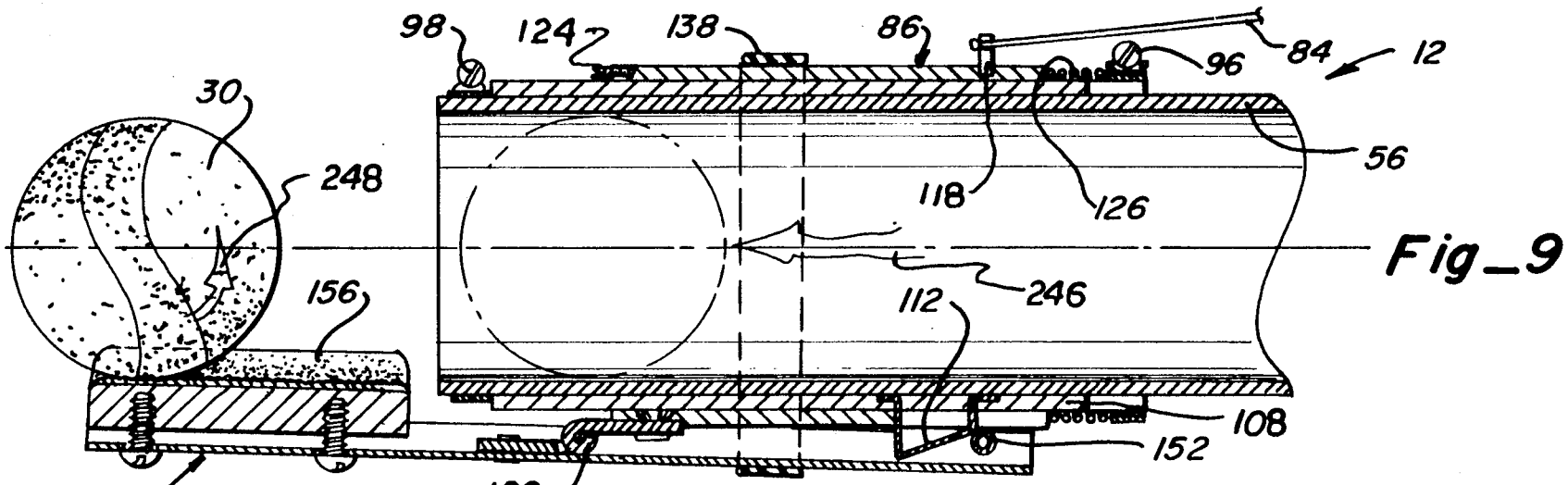
FIG. 9 is a sectional view taken along line 9—9 in FIG. 5.
Figure 10:
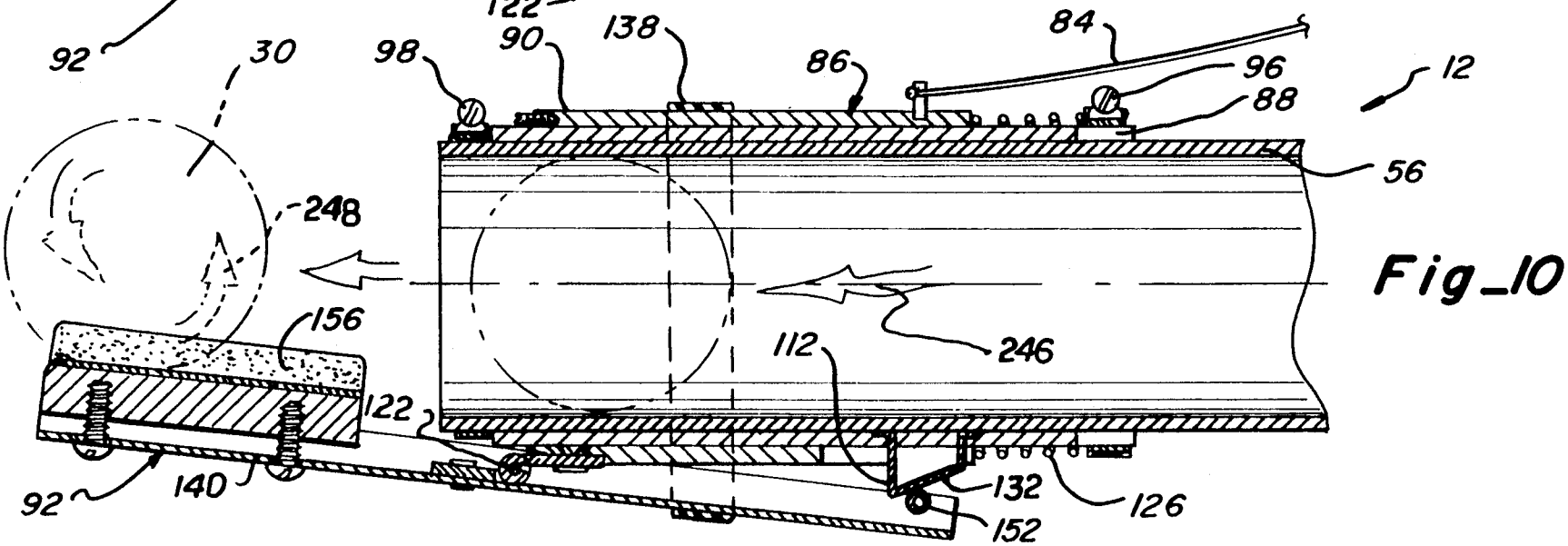
FIG. 10 is a view substantially identical to FIG. 9 illustrating a different operational position of the ball ejector barrel and the ball top spin actuator assembly connected thereto.

In the assembled condition of the automatic ball control apparatus 12 with the ball top spin actuator assembly 86 as noted in FIGS. 9 and 10, the fixed sleeve member 94 is telescopingly mounted about an outer end of the ball ejector barrel 56 and the sleeve anchor clamp 96 is mounted about the anchor slots 104 and clamped thereon.

The compression spring member 126 is telescopingly mounted about the fixed sleeve member 94 abutting the sleeve anchor clamp 96.

The movable sleeve member 108 is telescopingly mounted about the fixed sleeve member 94 having an inner end in abutting engagement with the compression spring member 126.

The stop sleeve clamp 98 is secured to an outer end of the ball ejector barrel 56 and serves as a limit to forward movement of the movable sleeve member 108 being urged in this direction by the compression spring member 126.

In this condition, it is noted that the movable sleeve member 108 has the spin actuator paddle assembly 92 pivotally connected thereto by the hinge member 122.

The paddle bias member 138 is telescoped about the movable sleeve member 108 and holds the main support lever member 140 in a position as noted in FIG. 9 which imparts the least top spin to a tennis ball member 30 being projected by the ball ejector machine 14.

The set screw 124 is movable axially so as to contact the sleeve stop clamp 98 providing an adjustment feature to control pivotal movement of the main support lever member 140 and, thus, amount of variable top spin to be imparted to the tennis ball member 30.

Next, the beaded chain member 84 is connected to the chain anchor bracket 118 secured to a top surface of the movable sleeve member 108. This beaded chain member 84 is adjustably connected between the support post member 32 and the chain connector bracket 118 to a desired tension which affects operation of the spin actuator paddle assembly 92.

In the operation of the ball top spin actuator assembly 86 in the assembled condition, it is obvious that the ball ejector machine 14 is placed on the tennis court 16 preferably behind the server's base line as noted in FIG. 4.

An electrical power cord is connected to the ball ejector machine 14 in order to power its operating mechanism. The ball ejector machine 14 may utilize a pneumatic type pressure ball ejecting means for propelling the tennis ball members 30 along the ball trajectories 20 as noted in FIG. 4.

At this time, the ball discharge assembly 28 would be energized and the barrel oscillating assembly 42 operates through the drive gear and motor assembly 64 with its rotating drive shaft 69 to move the second crank member 72 and the first crank member 70 in an oscillating motion to provide vertical movement to the ball ejector barrel 56.

Concurrently, the support post member 32 would be rotated in a back and forth motion in order to move the ball ejector barrel 56 in a lateral path.

On energization of the ball ejector machine 14, it is noted that the tennis ball members 30 are periodically projected outwardly through the ball ejector barrel 56 as noted by an arrow 246. As noted in FIG. 9, there is a minimum contact of the tennis ball members 30 with the arcuate contact surface 156 which imparts a rotational motion to the tennis ball members 30 as noted by an arrow 248.

In the condition of FIG. 9, it is noted that the movable sleeve member 108 is held against and compresses the compression spring member 126 due to pull excerted by the beaded chain member 84. This condition is caused when the barrel oscillator assembly 42 is in its lowermost position having a maximum pull by the beaded chain member 84.

The maximum condition of obtaining top spin on the tennis ball members 30 is noted in FIG. 10 which is at the uppermost vertical position of the ball ejector barrel 56 and there is a slack condition of the beaded chain member 84. The compression spring member 126 contacts a rear surface of the movable sleeve member 108 to move it to a forwardmost position.

In this maximum top spin condition, the roller member 152 contacts the inclined cam surface 132 of the paddle actuator cam member 112. This operates to pivot the main support lever member 140 about the hinge member 122 in a clockwise direction as noted in FIG. 10. This movement is against the force of the paddle bias member 138 which operates to move the main support lever member 140 in a counterclockwise direction when in the position as noted in FIG. 9.

The ball top spin actuator assembly 86 can be adjusted to provide varying top spin effects on the tennis ball members 30 through 1) adjustment of the beaded chain member 84 in its adjustable connection and amount of slack between the chain connector bracket 118 and the support post member 32; 2) adjustment of the set screw 124 in the adjustment opening 120 with its contact with the sleeve stop clamp 98; 3) adjustable axial movement of the arcuate support body 152 in the connector openings 148; and 4) using a paddle actuator cam member 112 having a different inclination from the inclined cam surface 132.

In the operation of the second embodiment of the ball top spin actuator assembly 162, basically the identical results are achieved on the tennis ball members 30 as shown in FIGS. 12 and 13.

In the assembly of the ball top spin actuator assembly 162, the fixed sleeve member 168 is telescoped over an outer end of the ball ejector barrel 56 into abutting engagement with the inner central ridge 169. The fixed sleeve member 168 is secured in position by the wing nut members 174 extended through the threaded anchor holes 170 into locking engagement with an outer surface of the ball ejector barrel 56.

The spin actuator paddle assembly 166 is pivotally connected by the support lever connector assembly 224 to the cam support channel 208 secured to an undersurface of the fixed sleeve member 168 by the anchor bolts 223.

Next, the beaded chain member 84 has its connector ring 231 mounted within and connected to the chain connector section 226 as noted in FIG. 12. The slack in the beaded chain member 84 can be adjusted with the opposite end fixed to a portion of the ball ejector machine 14 to affect the axial movement of the sliding cam assembly 210.

The lock bolt member 234 is preferrably constructed of a nylon material and a head portion 235 contacts the cam surface 196 of the actuator cam member 182 during operation. The lock bolt member 234 isd adjustable axially in the threaded anchor hole 232 to regulate pivotal movement of the main support lever 180 between minimum and maximum limits and resultant variable top spin imparted to the tennis ball members 30.

On operation of the second embodiment with the ball top spin actuator assembly 162, it is noted that tennis ball members 30 are projected by the ball ejector machine 14 outwardly through the ball ejector barrel 56 as noted by an arrow 250.

The condition in FIG. 12 applies a minimum amount of top spin to the tennis ball members 30 as noted by an arrow 252 in FIG. 12. The tennis ball members 30 contact the arcuate contact surface 201 to impart top spin to the propelled tennis ball members 30.

As noted in FIG. 12, there is a slack condition of the beaded chain member 84 whereupon the tension spring 236 holds the main cam body member 222 in a forward position. This slack condition would occur when the ball ejector barrel 56 is at its lowest point of trajectory caused by the barrel oscillating assembly 42 of the ball ejector machine 14.

In a maximum top spin condition as shown in FIG. 13, the tennis ball members 30 contact the arcuate contact surface 201 on the main support lever member 180 in its fully tilted position in a clockwise rotational movement.

In this maximum top spin condition, the actuator cam member 182 contacts the main cam body member 222 to cause the subject pivotal movement of the main support lever member 180. The main cam body member 222 is moved to a rearward position due to pull by the beaded chain member 84. This condition arises on the maximum vertical position of the ball ejector barrel 56 due to the oscillating movement through the barrel oscillator assembly 42.

The ball top spin actuator assembly 162 is adjustable between the minimum top spin condition of FIG. 12 and the maximum top spin condition of FIG. 13 through adjustment features being 1) adjustable movement of the ball actuator lever member 184 due to its bolt and slot interconnection to the main support lever member 180; 2) slack in the beaded chain member 84; 3) axial movement of the lock bolt member 234; and 4) replacement of the actuator cam member 182 having different inclinations of the cam surface 196.

In the ball top spin actuator assembly 162, the tension spring member 237 and the lower spring member 221 operate to move the main cam body member 222 to the minimum top spin condition.

It is noted in the automatic ball control apparatus 12 that both embodiments of the ball top spin actuator assemblies 86 and 162 operate similarly in achieving movement of the spin paddle assemblies 134 and 176 into different pivotal positions relative to the ball ejector barrel 56. The main difference being that, on various embodiments of ball ejector machines 14, the beaded chain member 84 may be attached to a respective ball ejector machine 14 either above or below the ball ejector barrel 56.

The automatic ball control apparatus is easily attachable to existing ball ejecting machines requiring a minimum amount of tools and skill plus utilizes existing holes and parts of the prior art tennis ball ejecting machines. The ball top spin actuator assemblies are economical to manufacture; easy to install on new or existing ball ejecting machines; readily adjustable to vary the top spin imparted to tennis ball members; compatible with the combination of oscillating and lateral movement of the ball ejector barrel; and substantially maintenance free.

It is obvious that the automatic ball control apparatus can be used to impart top spin to baseballs, ping pong balls, and the like.

While the invention has been described in conjunction with preferred specific embodiments thereof, it will be understood this description is intended to illustrate and not to limit the scope of the invention, which is defined by the following claims:

I claim:

1. An automatic ball control apparatus having a ball top spin actuator assembly connected to a ball ejector barrel on a ball ejector machine operable to impart variable top spin to a ball member being ejected therefrom, comprising:

a) a fixed extension sleeve assembly having a fixed sleeve member connected to an outer end of the ball ejector barrel;

b) a sliding actuator sleeve assembly having a movable sleeve member mounted about and axially movable on said fixed sleeve member and automatically movable from a minimum top spin to a maximum top spin condition and increments of top spin conditions therebetween acting on the ball member; and c) a spin actuator paddle assembly including a spin paddle assembly pivotally connected to said movable sleeve member and having a ball actuator lever member positioned adjacent and extended outwardly of an outer end of the ball ejector barrel;

whereby said movable sleeve member is moved axially on said fixed sleeve member on oscillating movement of the ball ejector barrel to pivot said spin paddle assembly to cause contact of said ball actuator lever member with the ball member to impart variable top spin thereto.

2. An automatic ball control apparatus as described in claim 1, wherein:

a) said sliding actuator sleeve assembly includes a paddle actuator cam member secured to, and extended laterally from, said fixed sleeve member; and b) said paddle actuator cam member is engagable with a portion of said ball actuator lever member on axial movment of said movable sleeve member to pivot same upwardly to a maximum top spin condition to contact and impart top spin to ball members being ejected through the ball ejector barrel of the ball ejector machine.

3. An automatic ball control apparatus as described in claim 1, wherein:

a) said top spin actuator assembly includes a paddle bias member placed about an outer surface of said movable sleeve member and in contact with said paddle actuator lever member to bias and move said movable sleeve member axially toward the minimum top spin condition.

4. An automatic ball control apparatus as described in claim 1, wherein:

a) said ball actuator lever member includes a support body having an upper, outer arcuate concave contact surface constructed of an abrasive material which is operable to contact and impart variable top spin motion to a ball member contacting said arcuate contact surface after being projected outwardly by the ball ejector machine.

5. An automatic ball control apparatus as described in claim 4, wherein:

a) said ball actuator lever member is releasably connected to said spin paddle assembly so as to be replaced due to the wear of said abrasive arcuate contact surface and adjustable axially to provide for increased contact with the ball members in the variable top spin conditions.

6. An automatic ball control apparatus as described in claim 1, including the ball ejector machine and the ball ejector barrel operable to be moved in a vertically oscillating path with conjoint lateral movement of the ball ejector barrel, wherein:

a) said movable sleeve member having a hinge member pivotally connected to said spin paddle assembly, a chain connector bracket connected to one end of a connector means and an opposite end connected to a portion of the ball ejector ejector machine; and b) said sliding actuator sleeve assembly includes a sleeve actuator member operable to bias said movable sleeve member axially to the maximum top spin condition which is a maximum pivotal movement of said main support lever member;

whereby said sleeve actuator member is operable to move said movable sleeve member in one direction to a maximum top spin position and said connector means is operable to move said movable sleeve member rearwardly on said fixed sleeve member to a minimum top spin position and imparting variable top spin to the ball member when said movable sleeve member is between the maximum and minimum top spin positions.

7. An automatic ball control apparatus having a ball top spin actuator assembly connected to a ball ejector barrel on a ball ejector machine operable to impart variable top spin to a ball member being ejected therefrom, comprising:

a) a fixed extension sleeve assembly having a fixed sleeve member connected to an outer end of the ball ejector barrel;

b) a sliding actuator sleeve assembly having a movable sleeve member mounted about and axially movable on said fixed sleeve member and automatically movable from a minimum top spin to a maximum top spin condition and increments of top spin conditions therebetween acting on the ball member;

c) a spin actuator paddle assembly including a spin paddle assembly pivotally connected to said movable sleeve member and having a ball actuator lever member positioned adjacent and extended outwardly of an outer end of the ball ejector barrel;

d) said movable sleeve member having a hinge member for pivotally connecting to said fixed sleeve member, a chain connector bracket connected to one end of a connector means and an opposite end connected to a portion of the ball ejector machine;

e) said sliding actuator sleeve assembly includes a sleeve actuator member operable to bias said movable sleeve member to the maximum top spin condition which is a maximum pivotal movement of said main support lever member; and f) said movable sleeve member having an adjustable opening at one end having a set screw therein which can be adjusted axially to limit an outward sliding movement of said movable sleeve member thereby controlling pivotal movement of said main support lever member to the maximum top spin condition thus providing adjustability thereof;

whereby said sleeve actuator member is operable to move said movable sleeve member in one direction for maximum top spin position and said connector means is operable to move said movable sleeve member rearwardly on said fixed sleeve member to the minimum top spin condition on imparting variable top spin to the ball member.

8. On a ball ejector machine including a ball propulsion mechanism to propel a ball member outwardly through a ball ejector barrel, means for moving the ball ejector barrel in lateral and vertically oscillating paths, an improvement involves the use therewith of an automatic ball control apparatus, comprising:

a) a fixed extension sleeve assembly connected to the ball ejector barrel and a spin actuator paddle assembly connected to said fixed extension sleeve assembly;

b) said spin actuator paddle assembly includes a spin paddle assembly pivotally connected to a cam actuator assembly connected to said fixed extension sleeve assembly; and c) said spin paddle assembly includes a main support lever member having a ball actuator lever member at one end engagable with a ball member to impart top spin thereto and an actuator cam member at another end engagable with said cam actuator assembly to reciprocally, continuously, and gradually pivot said main support lever member from a position of minimum to maximum to minimum top spin contact with the ball members to impart continuous variable top spin thereto;

d) said ball actuator lever member having an arcuate support body with an outer arcuate concave contact surface to contact the ball member; and e) said main support lever having a connector opening thereon to receive a portion of said arcuate support body therein for adjustable movement in said connector opening providing variations between minimum and maximum top spin conditions acting on the ball members being ejected from said ball ejector barrel.

9. On a ball ejector machine including a ball propulsion mechanism to propel a ball member outwardly through a ball ejector barrel, means for moving the ball ejector barrel in lateral and vertically oscillating paths, an improvement involves the use therewith of an automatic ball control apparatus, comprising:

a) a fixed extension sleeve assembly connected to the ball ejector barrel and a spin actuator paddle assembly connected to said fixed extension sleeve assembly;

b) said spin actuator paddle assembly includes a spin paddle assembly pivotally connected to a cam actuator assembly connected to said fixed extension sleeve assembly;

c) said spin paddle assembly includes a main support lever member having a ball actuator lever member at one end engagable with a ball member to impart top spin thereto and an actuator cam member at another end engagable with said cam actuator assembly to reciprocally pivot said main support lever member from a position of minimum to maximum top spin contact with the ball members; and d) said cam actuator assembly includes 1) a cam support channel secured to said fixed extension sleeve assembly; and 2) a sliding cam assembly connected to said cam support channel and operably engagable with said main support lever member in order to cause pivotal movement thereof and, thus, move said ball actuator lever member into and out of contact with a ball member adjacent an outer end of said ball ejector barrel to regulate the amount of variable top spin imparted to a ball member being ejected therefrom.

10. An automatic ball control apparatus as described in claim 9, wherein:

a) said sliding cam assembly includes a main cam body held in a retracted position by a spring member and a lever spring member biases said main support lever toward position of minimum top spin condition; and b) said main cam body member attached to a connector means which is attached to a portion of the ball ejector barrel;

whereby movement of the ball ejector barrel to its maximum vertical position of oscillating movement causes movement of said main cam body member rearwardly so as to engage a portion of said actuator cam member to pivot said main support lever member toward its maximum pivotal movement to cause maximum contact with the ball member being ejected from the ball ejector barrel to achieve a maximum top spin condition.

11. An automatic ball control apparatus as described in claim 10, wherein:

a) said main cam body member having a connector section having a lock bolt member threadably mounted therein and engagable with said actuator cam member on outward movement of said main cam body member caused by connection of said connector means and oscillation of said ball ejector barrel to cause movement upwardly of said ball actuator lever member to the maximum top spin condition; and b) said lock bolt member selectively axially movable as an adjustment feature to regulate amount of pivotal movement of said main support lever member to control amount of maximum top spin condition achieved.

12. An automatic tennis ball ejector machine operable to impart lateral and vertical oscillating motion to tennis ball members being expelled from a ball ejector barrel with this invention being an automatic ball control apparatus to add top spin to the expelled tennis ball members, comprising:

a) a sleeve member connected to an outer end of a ball ejector barrel of a ball ejector machine;

b) an actuator assembly mounted on said sleeve member;

c) a spin paddle actuator assembly including a main support lever member engagable with said actuator assembly and pivotally movable relative to said sleeve member with a ball actuator lever member movable continuously and gradually from minimum to maximum to minimum continuous interference with a tennis ball member ejected from an outer end of said ball ejector barrel to impart from minimum to maximum top spin conditions and increments of top spin therebetween to the tennis ball members; and d) connector means adjustably connected to said actuator assembly and a stationary portion of said ball ejector machine to automatically and continuously pivot said support lever member on vertical movement of said ball ejector barrel;

whereby said actuator assembly is moved at a maximum height assimilating a position of said ball ejector barrel to achieve the maximum top spin condition to the tennis ball members contacting said main support lever member.

13. An automatic tennis ball ejector machine as described in claim 12, wherein:

a) said a actuator assembly movable axially on said sleeve member to a forward condition through a bias member to achieve the maximum top spin condition and movable to the position of minimum top spin condition by the use of said connector means; and b) said connector means can be adjustably connected between said movable connector assembly and said stationary portion of said ball ejector machine to regulate the amount of maximum top spin condition to be imparted to the tennis ball members.

14. An automatic tennis ball ejector machine as described in claim 12, wherein:

a) said actuator assembly movable to a maximum top spin condition due to pull by said connector means which is achieved when said ball ejector barrel is positioned at its uppermost position of vertical oscillatory movement; and b) said main support lever member is positioned at a minimum top spin condition with slack in said connector means which is achieved when said ball ejector barrel isd positioned at its lowermost position of vertical oscillating movement.

15. An automatic tennis ball ejector machine as described in claim 12, wherein:

a) said actuator assembly movable to a maximum top spin condition due to slack in said connector means which is achieved when said ball ejector barrel is positioned at its uppermost position of vertical oscillatory movement; and b) said main support lever member is positioned at a minimum top spin condition due to pull by said connector means which is achieved when said ball ejector barrel is positioned at its lowermost position of vertical oscillatory movement.

16. An automatic ball control apparatus as described in claim 12, wherein:

a) said actuator assembly is reciprocally mounted on said sleeve member operable to pivot said ball actuator lever member into continuously variable contact with the tennis ball member to impart continuously variable top spin thereto.

17. An automatic ball control apparatus as described in claim 12, wherein:

a) said actuator assembly includes 1) a cam support channel secured to said sleeve member; and 2) a sliding cam assembly connected to said cam support channel and operably engagable with said main support lever member in order to cause pivotal movement thereof and, thus, move said ball actuator lever member into and out of continuous variable contact with the tennis ball members to achieve variable top spin.

18. An automatic ball control apparatus as described in claim 17, wherein:

a) said sliding cam assembly includes a main cam body held in a retracted position by a spring member and a lever spring member biases said main support lever member toward position of minimum top spin condition; and b) said main cam body member attached to a connector means which is attached to a portion of the ball ejector barrel;

whereby movement of the ball ejector barrel to its maximum vertical position of oscillating movement causes movement of said main cam body member rearwardly so as to engage a portion of said actuator cam member to pivot said main support lever member toward its maximum pivotal movement to cause maximum contact with the ball member being ejected from the ball ejector barrel to achieve a maximum top spin condition.

19. An automatic ball control apparatus as described in claim 18, wherein:

a) said main cam body member having a connector section having a lock bolt member threadably mounted therein and engagable with said actuator cam member on outward movement of said main cam body member caused by connection of said connector means and oscillation of said ball ejector barrel to cause movement upwardly of said ball actuator lever member to the maximum top spin condition; and b) said lock bolt member selectively axially movable as an adjustment feature to regulate amount of pivotal movement of said main support lever member to control amount of maximum top spin condition achieved.

* * * * *